United States Patent [19]

Ettema

[11] 4,225,046

[45] Sep. 30, 1980

[54] PLASTIC TRAY FOR FRUIT OR LIKE PRODUCTS

[75] Inventor: Ernst Ettema, Hardenberg, Netherlands

[73] Assignee: Wavin B.V., Zwolle, Netherlands

[21] Appl. No.: 961,006

[22] Filed: Nov. 15, 1978

[30] Foreign Application Priority Data

Nov. 17, 1977 [NL] Netherlands ..... 7712760

[51] Int. Cl.[2] ..... B65D 21/00; A47J 47/00

[52] U.S. Cl. ..... 206/511; 206/821; 211/126

[58] Field of Search ..... 206/512, 511, 509, 516, 206/821; 211/126; 220/85 R, 85 K

[56] References Cited

U.S. PATENT DOCUMENTS

| | | | |
|---|---|---|---|
| 1,957,153 | 5/1934 | Smiley, Jr. | 211/126 |
| 2,894,640 | 7/1959 | Bigelow | 211/126 |
| 3,445,034 | 5/1969 | Rehrig | 206/821 X |
| 3,533,512 | 10/1970 | Serwer | 211/126 |
| 4,039,119 | 8/1977 | Crane | 206/821 X |
| 4,120,444 | 10/1978 | Gray | 206/511 X |

FOREIGN PATENT DOCUMENTS

| | | |
|---|---|---|
| 2428316 | 1/1976 | Fed. Rep. of Germany . |
| 1560076 | 2/1969 | France . |
| 2140315 | 1/1973 | France . |
| 6502985 | 9/1965 | Netherlands . |
| 7701259 | 2/1977 | Netherlands . |

*Primary Examiner*—Steven M. Pollard

*Attorney, Agent, or Firm*—Wilkinson, Mawhinney & Thiebault

[57] ABSTRACT

A tray for packaging fruit comprising a base and converging side walls, is provided with a wide rim at its upper side, said rim being integral with a suspending ledge, while a support can be pushed through an opening in the rim at the corners of the tray and a staggered part of the support fits the ledge, the support also being fixed by cams at the base of the tray.

10 Claims, 5 Drawing Figures

PLASTIC TRAY FOR FRUIT OR LIKE PRODUCTS

BACKGROUND OF THE INVENTION

The invention relates to a tray or basket of plastic comprising a base and side walls converging toward said base, at least the corner parts of the side walls including a wide rim having a ledge suspending outside the rim or rims, the outside of said tray enabling the mounting of a support.

A tray of this type is known per se. The known tray is shaped such, that a number of crates can be nested. In the corners of the side walls the wide rim at the upper side of the side walls is bulged toward an upward direction and the ledge suspending at the outside serves for receiving a support which fits on the outside of a corner of the tray. Said outside supports serve to stack the trays upon each other and a stack thus formed can be transported, while there is still a small clearance between each stacked individual tray.

A number of solutions for stacking trays which can be nested without supports have been proposed, but they have been in vain, as supports outside the tray appear to be prefered in practice.

In plastic trays the wall thickness of the material should necessarily be as thin as possible. The structure of the trays has however to be such, that the trays are stable when they contain packed fruits or foodstuffs or other merchandise and have to be transported.

SUMMARY OF THE INVENTION

The invention aims to improve the quality of a tray of the abovementioned type so that the trays are stable at a minimum of plastics.

This is achieved in accordance with the invention in that in each corner of the tray the upper surface of the wide rim behind the ledge is provided with an opening being adapted to the circumference of the support for pushing the support through said opening, the tray comprising one or more retaining members engaging adapted parts of the support, appropriately accomodated in the opening, said retaining members advantageously being situated at a distance from and under the wide rim. The said members ensure a firm fixing of the support(s) at the upper rim of the tray and at the lower rim of the tray, thus warranting a very stable stacking of the trays.

A firm fixing of the support to the tray is caused by the fact that the structure of the said support is thus, that the opening in the upper surface of the wide rim extends toward the ledge and the side of the support to be positioned behind the ledge is provided with a staggered part for fitting the edge of the opening.

The height of the staggered portion of the support should correspond to the height of the ledge, so that the latter matches said portion entirely.

Owing to the said action, the support is firmly fixed within the corner of the tray and cannot possibly get detached during the transport of a stack of said trays.

SURVEY OF THE DRAWINGS

DESCRIPTION OF A PREFERRED EMBODIMENT

Figure 1:
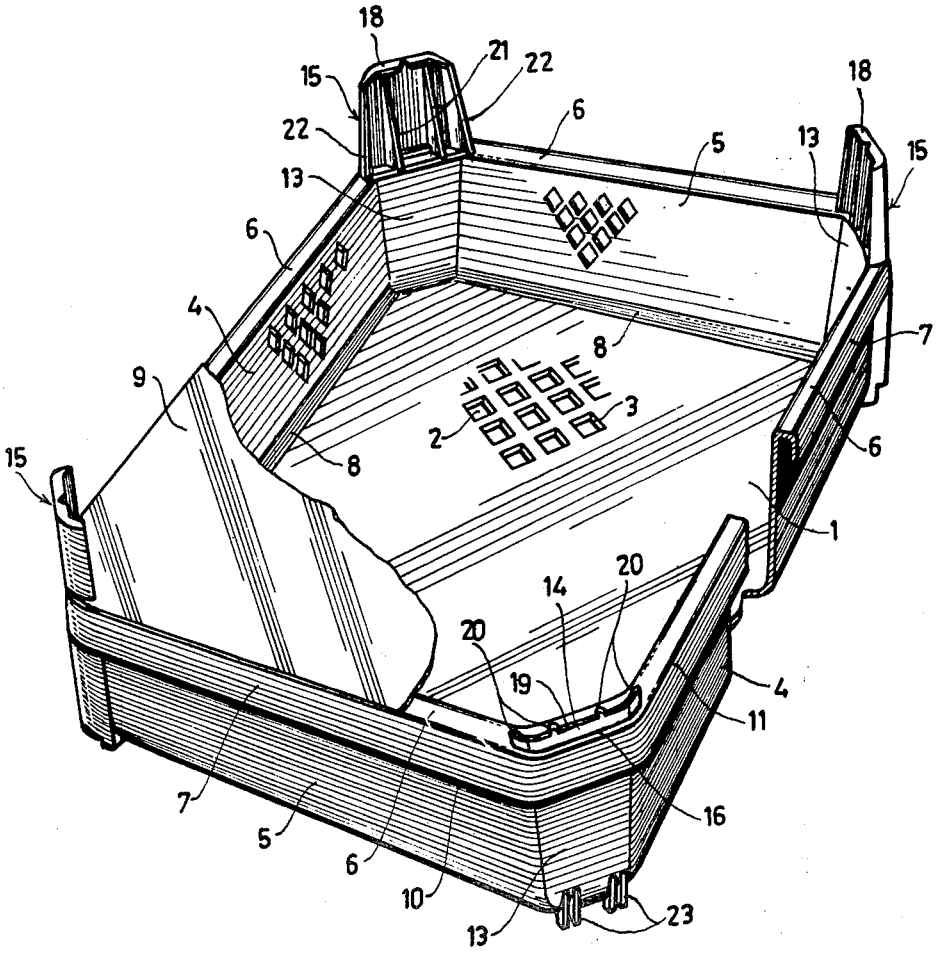
FIG. 1 is a perspective view of a tray according to the invention, one support being removed, and partially showing a cover for the tray.
Figure 2:
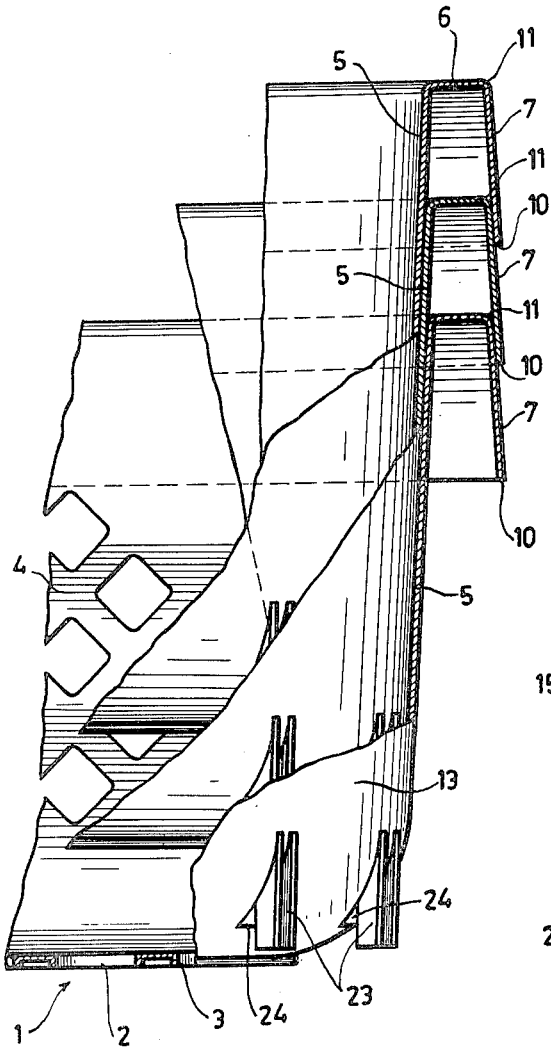
FIG. 2 is a side view of a corner of the tray, merging into a cross sectional view of a part of nested trays in accordance with the invention.

FIG. 1 shows an embodiment of a tray according to the invention, consisting of a flat base 1, having a pattern of apertures 2 with bent over edges 3. The base comprises long side walls 4 and short side walls 5, also being provided with opening, however without bent back edges for reasons to be explained hereinafter.

In the embodiment of FIG. 1, the base 1 is substantially rectangular and the walls 4 and 5 converge toward the base. This enables a number of packs to be nested, the nesting depth being dependent upon the angle of the walls 4 and 5 with respect to each other. The nesting depth is also defined by a wide rim 6 above each wall 4 and 5 which rim is bent outward and is provided with a suspending ledge 7. This provides a particular rigidity of the side walls 4 and 5 so that they are rigid due to the angle 8 between the base and the wide rim 6. Owing thereto the openings in the side walls 4 and 5 need not be bent back. The wide rim 6 can also be used for applying a covering sheet 9 which can be affixed to said rim by means of a thermal welding procedure. The shape of the ledges is such that they can engage each other when the trays are nested. Therefore the circumference of the bottom flange 10 of the ledges 7 exceeds the circumference of the corner 11 between the wide rim 5 and the ledge 7. It is also possible to provide reinforcement ribs between the ledges 7 and the walls 4 and 5, respectively.

It will be obvious that the tray can be manufactured by an injectionmolding process in a simple mold. The corners of the substantially rectangular tray are beveled in a manner known per se, which beveled part is referenced 13 in FIGS. 1 and 3. The extension of the wide rims 6 of all walls 4 and 5 form one plane, extending parallel to the base 1, thus causing the tray to be extremely rigid.

Thus an opening 14 can be applied in the wide rim 6 near the beveled corners 13. Said opening or openings 14 can be made rather large, owing to the rigidity obtained due to the combination of wide rims 6 and suspending ledges 7 and they will also not decrease the strength of the tray after having fixed the supports 15; this will be explained hereinafter in detail.

The supports 15 can also be manufactured by an injection-molding process. The outer shape of said supports is unimportant as both flat, round or angular shapes can be used. It is essential, however, that the outer edge 16 of the opening 14 lying beside the ledge 7, almost extends up to that ledge. The circumferential edges of the opening 14, including the edge 16, are adapted to the dimensions of the supports 15. The outer edge 16 fits in a recessed or staggered part 17 of the support 15, the height of which part being equal to the height of the ledge 7, the depth corresponding to the thickness of the ledge 7. The latter is, however, not essential.

Figure 3:
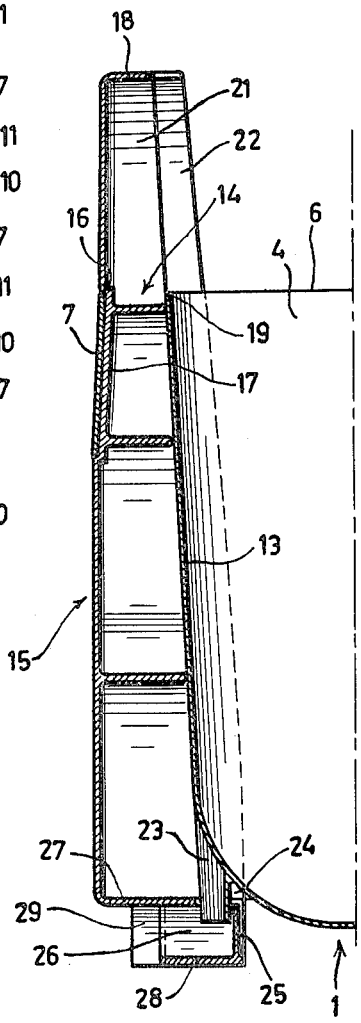
FIG. 3 is a vertical cross section of a support.
Figure 4:
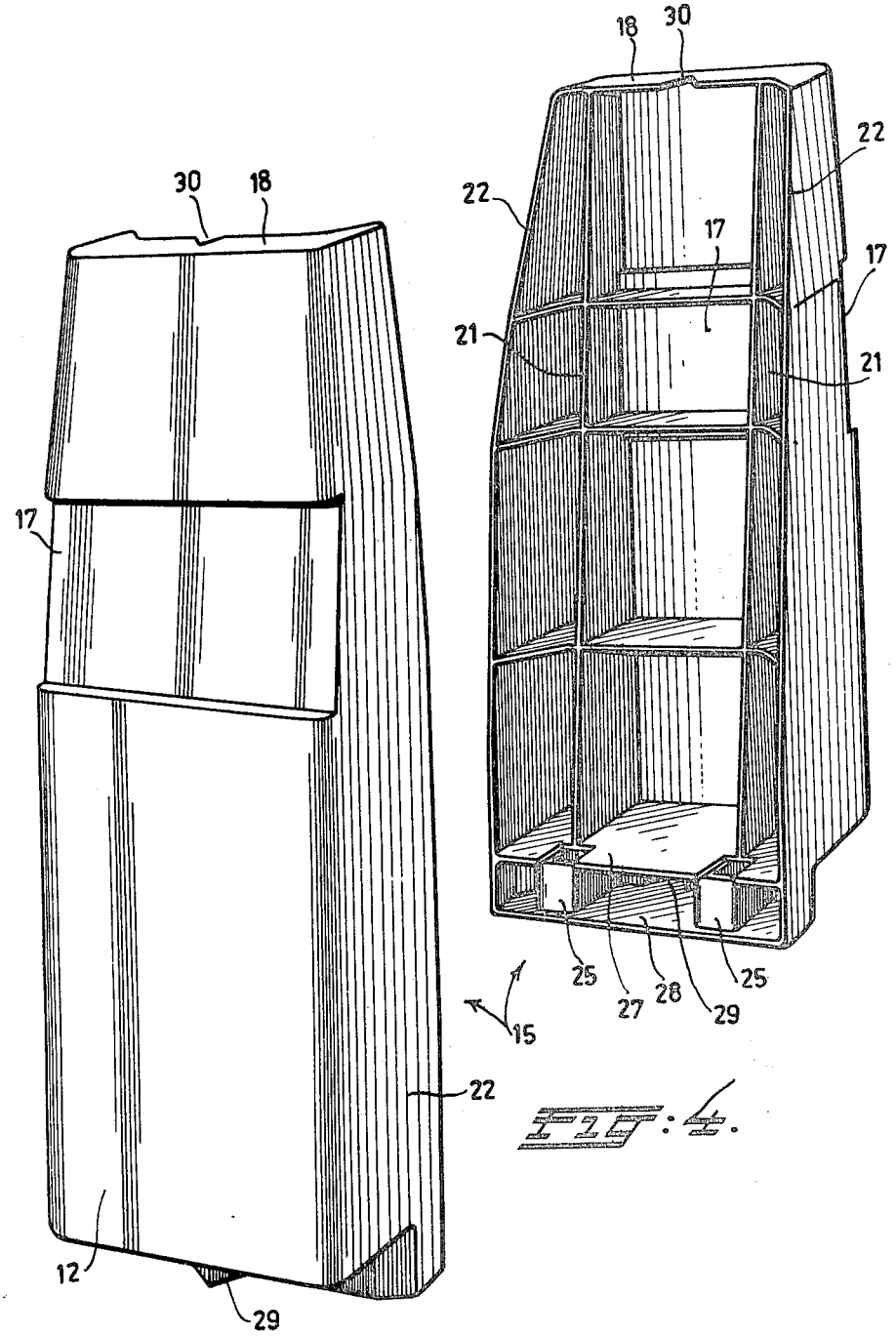
FIG. 4 shows two perspective views of a support seen from outside the tray and from inside the tray.

FIG. 3 shows the recessed part 17 with a ledge 7 fitting therein.

The supports 15 are pushed into the openings 14 from the lowermost point behind the ledges 7, until said ledges engage the recessed or staggered part 17. It is obvious that the supports 15 protrude to above the openings 14 and that the length of the supports 14 exceeds the height of the tray wherein the said supports are applied. The height of the part of the support 15 protruding above the opening 14 is such, that a plurality of trays can be stacked upon each other, having a small clearance in between them. The walls of the parts protruding above the openings 14 preferably converge with respect to an end face 18 of said protruding parts of the supports 15, so that they can easily be pushed into the openings 14.

The edges 19 directed toward the inside of the tray may be provided with slits 20, in which the edges of ribs 21 and 22 of the supports fit. The said ribs 21 serve as a reinforcement of the supports 15 and though their shape need not be defined, it is such, that the ribs adjoin the beveled edges 13 of the tray. The ribs 22, however, form part of the outer wall of the supports 15, having in their central part 12 the recessed portion 17.

As the material for the walls 4 and 5 and the base 1 should be as thin as possible, pushing supports through openings will not necessarily provide a good stable tray. According to the invention additional reinforcement means may be provided in the vicinity of the base 1 of the tray.

The invention provides locking means situated at distance from the opening 14 and near the base 1 of the tray. Thus the opening 14 provides on the one hand an enclosure of the support 15 which also reinforces the corner of the wide rim 6 by adjoining the ledge 7 to the support 15, said ledge 7 also embracing the support 5.

Remote therefrom locking means are present in the shape of cams 23 on the beveled part 13. They are integral with the beveled part 13 and are simultaneously formed during the injection-molding process. Said cams 23 also have a recessed part 24, so that they protrude downwardly in the shape of a hook.

The cams 23 thus form hooks which engage a cam 25 of a support 15. Said hooks or cams 23 fit in a chamber 26, being formed by a recessed lower wall 27 and a protruding lower wall 28, situated at the lower end of the support 15. The said cams 23 are mounted pairwise, their width being such that they exactly match each chamber 26, so that the support 15 is not able to shift sidewise. The central part of the back wall of a chamber comprises a V-shape cam fitting in a V-shape slit 30 being present in the upper surface 18 of a support 15 mounted thereunder. A stable stacking of the trays is thus provided. When the trays have been stacked each bottom face 27 of a support 15 will be carried by an upper surface 18 of the support 15 being disposed below said surface 18.

It will be obvious that by using four detachably fixed supports 15 each tray covers a small space as the said tray can be nested, thus allowing an easy transport and storage. The personnel using the trays will push the supports 15 into the openings 14 after the filling of the tray for instance, with tomatoes or the like.

It is also possible to manufacture a number of trays in anticipation.

Figure 5:
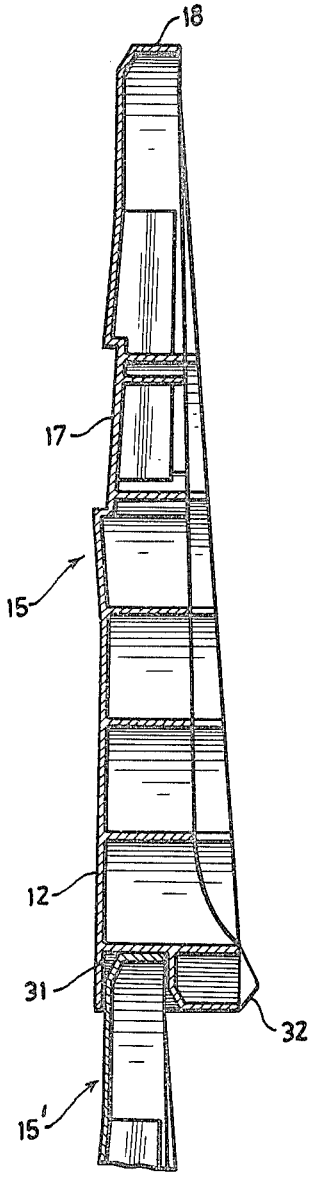
FIG. 5 shows a cross section of another embodiment of a support.

FIG. 5 shows a cross section of another embodiment of a support 15 and part of another support 15' accomodated in a chamber 31 formed by an extending wall 12. This increases the stability of a stack of trays.

The lower inner side of a support 15 may be provided with sliding ribs 32 extending outside the support. These ribs extend obliquely outwardly and are integral with inner reinforcing walls of the support.

What is claimed is:

1. In combination, a tray of plastic comprising a base and side walls converging toward said base, at least the corner parts of the side walls including a wide rim having a ledge suspending outside the rim, a plurality of external stacking supports, the upper surface of the wide rim behind the ledge in each corner of the tray having an opening adapted to resiliently engage the support to permit pushing the support through said opening, said tray comprising one or more retaining members positioned to resiliently engage and lock with parts of the support.

2. The tray of claim 1, the opening in the upper face of the wide rim extending toward the region of the ledge, said support adapted to be positioned behind said ledge, and having a staggered part fitting at least the edge of the opening.

3. The tray of claim 1, wherein the height of the staggered part of the support corresponds to the height of the ledge thus causing said support to fit entirely within said staggered part.

4. The tray of claim 1, wherein each support has a length exceeding the height of the side walls of said tray having the wide rim, said the walls of said support converge at least in the area of said support protruding above the wide rim of said tray.

5. The tray of claim 1, wherein the retaining members are hook-shaped parts engage, the end of a retaining part engaging a locking part of said stacking supports, when said support is pushed into the opening in the wide rim of said tray.

6. The tray of claim 1, wherein the edge of the opening in the wide rim at the side facing the side walls, comprises slits for receiving parts of the support.

7. The tray of claim 1, wherein the support comprises one or more chambers in an endpart to be positioned near the base of the tray, which chambers present an opening for receiving protruding hook-shaped cams at the outside of the side walls at a corner of the tray.

8. The tray of claim 1, wherein the wide rim with suspending ledge extends along the whole circumference of the tray the upper face of said rim being in a plane parallel to the base of the tray.

9. The tray of claim 1, wherein the bottom side of the supports are provided with a chamber for receiving the upper side of another support.

10. The tray of claim 1, wherein the support is provided with sliding ribs positioned at the bottom of the supports.

* * * * *